US005099541A

United States Patent [19]

Tressler

[11] Patent Number: 5,099,541

[45] Date of Patent: Mar. 31, 1992

[54] BLACKBOARD ERASER APPARATUS

[76] Inventor: Doyle M. Tressler, Box 251 B RD#2, Mill Hall, Pa. 17751

[21] Appl. No.: 640,610

[22] Filed: Jan. 14, 1991

[51] Int. Cl.[5] ..... B43L 21/00

[52] U.S. Cl. ..... 15/257.05; 15/104.92; 15/260; 15/244.1

[58] Field of Search ..... 15/257.05, 260, 244.1, 15/104.92; 401/121, 123, 125, 118; 220/574, 575, 556, 521, 570, DIG. 6; 206/229; 434/417

[56] References Cited

U.S. PATENT DOCUMENTS

| | | | |
|---|---|---|---|
| 1,449,856 | 3/1923 | Hampson | 15/244.1 |
| 1,660,351 | 5/1927 | Pataki | 15/244.1 |
| 2,671,239 | 3/1954 | Wisner | 15/260 |
| 3,341,876 | 9/1967 | Campbell | 15/260 |

FOREIGN PATENT DOCUMENTS

| | | | |
|---|---|---|---|
| 0404890 | 12/1909 | France | 401/121 |
| 6717504 | 10/1968 | Netherlands | 15/244.1 |
| 0177958 | 4/1922 | United Kingdom | 15/143 R |
| 0365321 | 1/1932 | United Kingdom | 15/143 R |
| 1036428 | 7/1966 | United Kingdom | 15/257.05 |

*Primary Examiner*—Harvey C. Hornsby
*Assistant Examiner*—Reginald L. Alexander
*Attorney, Agent, or Firm*—Leon Gilden

[57] ABSTRACT

An apparatus including a lid removably mounted relative to an underlying container, wherein the lid includes a first and second trough spaced juxtaposed to a central trough, wherein the central trough includes an apertured floor, and the first and second troughs are each arranged for selective securement of fluid therewithin. A sponge assembly includes a plate member to overlie the first and second troughs mounting a sponge to the bottom surface of the plate member. The sponge is defined by a sponge height less than a first trough height of the first and second troughs, wherein a second trough height of the central trough is less than the sponge height to permit compression of the sponge within the central trough and removal of excess fluid therefrom. A serpentine handle is mounted to a top surface of the support plate for enhanced manual grasping of the eraser member.

1 Claim, 2 Drawing Sheets

BLACKBOARD ERASER APPARATUS

BACKGROUND OF THE INVENTION

1. Field of the Invention

The field of invention relates to blackboard eraser apparatus, and more particularly pertains to a new and improved blackboard eraser apparatus wherein the same provides convenience of a fluid for cleaning of blackboard structure.

2. Description of the Prior Art

To permit cleaning of blackboard eraser surfaces, it is desirable to direct a cleaning fluid, such as water, thereto. Chalk and chalk dust accumulated upon a blackboard surface is not frequently cleaned sufficiently by mere application of a dry eraser. The invention attempts to overcome deficiencies of the prior art by providing an eraser structure to permit use of at least one fluid applicator eraser for enhanced cleaning of a blackboard surface.

Prior art structure may be found in U.S. Pat. No. 905,450 to McAllister wherein a container includes a continuous apertured floor to permit residue chalk dust to be received within the container structure of the organization.

U.S. Pat. No. 4,872,237 to Smith is a chalk dust remover permitting a further example of continuously apertured floor for mounting of an eraser therewithin to receive chalk dust therethrough.

U.S. Pat. No. 4,742,594 to Chen sets forth a blackboard eraser organization for removal of dust from an eraser structure utilizing roller structure for this purpose.

U.S. Pat. No. 4,549,327 to Johnson sets forth a chalk dust receptacle structure for scraping of an eraser and and underlying container to receive the chalk dust therewithin.

U.S. Pat. No. 4,596,059 to Lee sets forth a plurality of rollers arranged for removal of chalk dust from eraser structures.

As such, it may be appreciated that there continues to be a need for a new and improved blackboard eraser apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of blackboard eraser apparatus now present in the prior art, the present invention provides a blackboard eraser apparatus wherein the same utilizes a fluid-filled trough structure to direct fluid for absorption within a sponge eraser and the sponge eraser arranged for dispelling of excess fluid utilizing a central trough. As such, the general purpose of the present invention, which will be described subsequently in greater detail, is to provide a new and improved blackboard eraser apparatus which has all the advantages of the prior art blackboard eraser apparatus and none of the disadvantages.

To attain this, the present invention provides an apparatus including a lid removably mounted relative to an underlying container, wherein the lid includes a first and second trough spaced juxtaposed to a central trough, wherein the central trough includes an apertured floor, and the first and second troughs are each arranged for selective securement of fluid therewithin.

A sponge assembly includes a plate member to overlie the first and second troughs mounting a sponge to the bottom surface of the plate member. The sponge is defined by a sponge height less than a first trough height of the first and second troughs, wherein a second trough height of the central trough is less than the sponge height to permit compression of the sponge within the central trough and removal of excess fluid therefrom. A serpentine handle is mounted to a top surface of the support plate for enhanced manual grasping of the eraser member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved blackboard eraser apparatus which has all the advantages of the prior art blackboard eraser apparatus and none of the disadvantages.

It is another object of the present invention to provide a new and improved blackboard eraser apparatus which may be easily and efficiently manufactured and marketed.

It is a further object of the present invention to provide a new and improved blackboard eraser apparatus which is of a durable and reliable construction.

An even further object of the present invention is to provide a new and improved blackboard eraser apparatus which is susceptible of a low cost of manufacture with regard to both materials and labor, and which accordingly is then susceptible of low prices of sale to the consuming public, thereby making such blackboard eraser apparatus economically available to the buying public.

Still yet another object of the present invention is to provide a new and improved blackboard eraser apparatus which provides in the apparatuses and methods of the prior art some of the advantages thereof, while simultaneously overcoming some of the disadvantages normally associated therewith.

Still another object of the present invention is to provide a new and improved blackboard eraser apparatus wherein the same utilizes at least one fluid-filled trough in association with a central trough to permit removal of excess fluid by the central trough for enhanced cleaning of a blackboard surface of chalk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
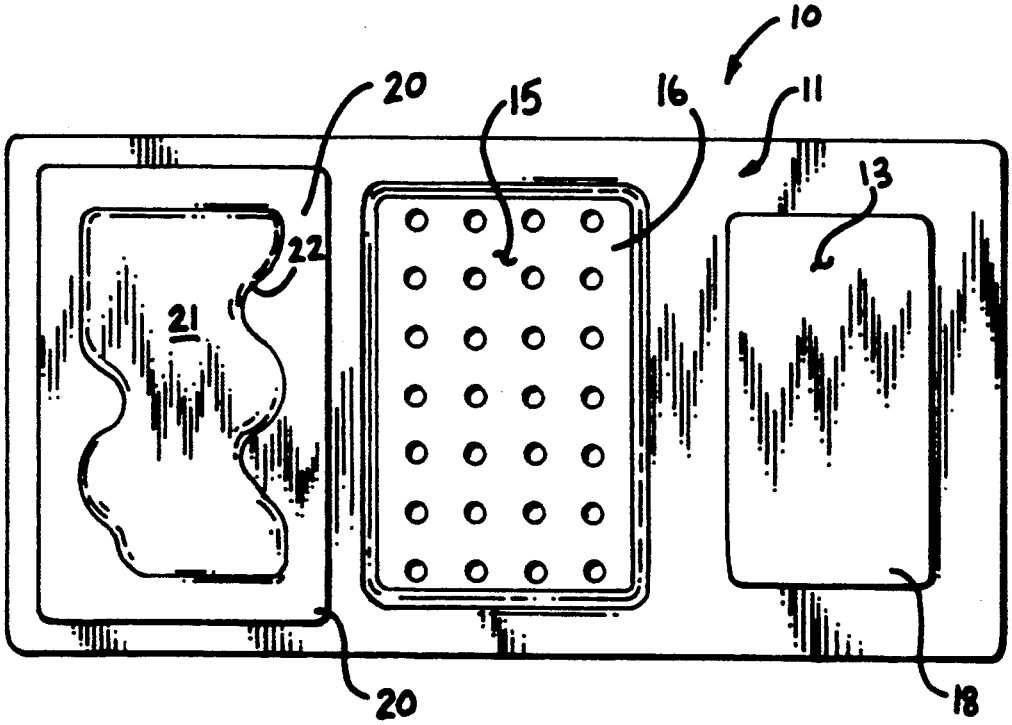
FIG. 1 is an orthographic top view of the instant invention.
Figure 2:
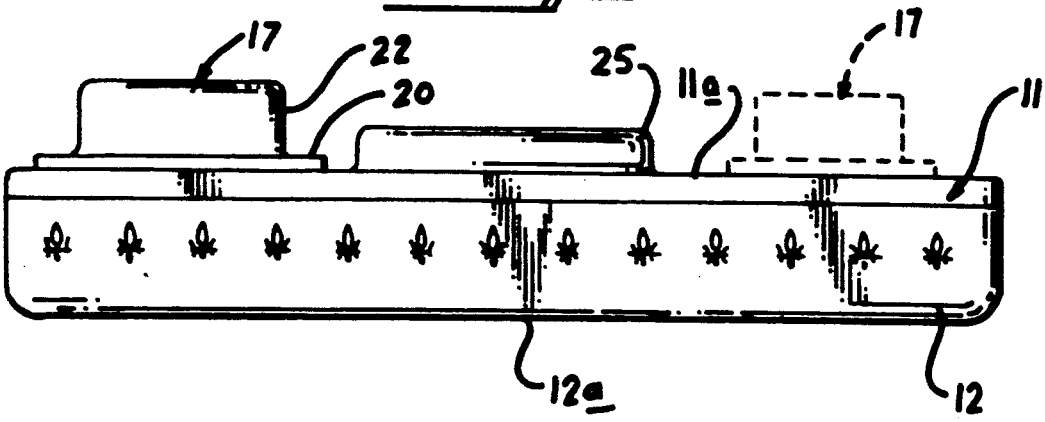
FIG. 2 is an orthographic side view of the instant invention.
Figure 3:
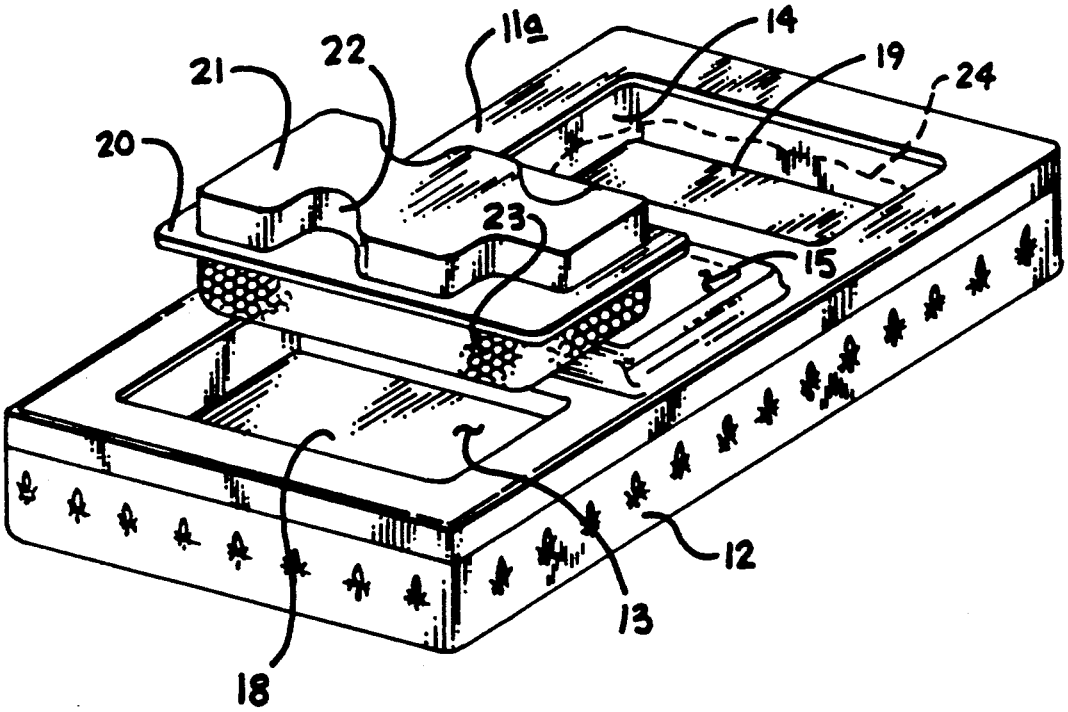
FIG. 3 is an isometric illustration of the instant invention.

With reference now to the drawings, and in particular to FIGS. 1 to 3 thereof, a new and improved blackboard eraser apparatus embodying the principles and concepts of the present invention and generally designated by the reference numeral 10 will be described.

More specifically, the blackboard eraser apparatus 10 of the instant invention essentially comprises a support plate lid 11 including a planar lid top surface 11*a*. The lid 11 is removably mounted relative to an underlying container 12 that includes a container floor 12*a* spaced below the top surface 11*a*. A first trough 13 and a second trough 14 are formed within the support plate lid 11 extending below the top surface 11*a*, and each include a respective first and second trough fluid impermeable floor 18 and 19, wherein each trough floor is positioned below the top surface 11*a* a first predetermined height. Each trough further includes trough side walls that define a parallelepiped configuration of the first predetermined trough height and are each defined by a first predetermined length and a first predetermined width. A central trough 15 is positioned medially of the first and second troughs 13 and 14, and include an apertured floor 16, and a central trough rim 25 defined by a second predetermined trough height. The second predetermined trough height is less than the first predetermined trough height and less than a predetermined sponge height defined by a sponge member 23 of an eraser assembly 17. The eraser assembly 17 includes an eraser plate 20 integrally mounting an eraser handle 21 to a top surface of the eraser plate 20, wherein the eraser handle 21 is defined by a serpentine continuous side wall 22. Further it should be noted that the eraser plate 20 is defined by a second predetermined length greater than the first predetermined length and a second predetermined width greater than the first predetermined width to position the eraser plate 20 overlying each respective first and second trough 13 and 14 to limit penetration of the sponge member 23 within each respective first and second trough 13 and 14. It should be further noted that the sponge height is less than the first predetermined trough height, wherein a water level 24 (see FIG. 3) contained within at least one of the first and second troughs 13 and 14 is arranged for saturating the sponge member 23 with water or suitable cleaning fluid for effecting erasure of an associated blackboard surface (not shown), wherein blackboard type surfaces are of conventional construction well known to those of ordinary skill in the art.

In use, at least one of a plurality of eraser members 17 positioned within the first and second troughs 13 and 14 effect fluid saturation of the associated sponge member 23. Excess fluid from each sponge member is removed therefrom by manually compressing the sponge member 23 within the central trough 15 against the apertured floor 16, wherein the apertured floor 16 is spaced above the container floor 12*a*, whereupon such excess fluid is received within the container 12. Subsequent filling of the container 12 by removal of the lid 11 from the container 12 and permits emptying of the container 12 as required. As the second trough height is less than the predetermined sponge height, compression of the sponge member 23 is effected during such manual compression of the sponge within the central trough 15. If desired, one of the troughs 13 or 14 may be maintained and devoid of fluid to provide alternate use of a dry eraser in association with a wet eraser, wherein at least one of the troughs are provided with cleansing fluid, in a manner as noted above.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A blackboard eraser apparatus comprising:

a support plate lid, the support lid including a plate lid top surface, the support plate lid removably mounted relative to an underlying container, and the support plate lid including a first trough spaced from a second trough, and a central trough positioned medially of the first and second troughs, and an eraser assembly selectively and removably mounted within either of the first and second troughs, and wherein the central trough includes an apertured floor, and a central trough rim formed about the central trough, and the apertured floor spaced below an upper terminal end of the central trough rim a second predetermined trough height, and the first and the second trough include a respective first fluid impermeable trough floor and a second fluid impermeable trough floor, wherein the first trough floor and the second trough floor are spaced below the top surface a first predetermined trough height greater than the second predetermined trough height, and each eraser assembly includes an eraser plate, the eraser plate defined by a second predetermined length and a second predetermined width, wherein the first trough and the second trough are each defined by a first predetermined height and a first predetermined width, wherein the second predetermined height is greater than the first predetermined height and the second predetermined width is greater than the first predetermined width, and a sponge member fixedly mounted to a bottom surface of an eraser plate complementarily received within each respective first and second trough, and the sponge member defined by a predetermined sponge height less than the first predetermined height and greater than the second predetermined height, wherein at least one of said troughs includes a predetermined quantity of fluid therewithin to permit manual compression of the sponge member within the central trough upon removal of an eraser assembly from one of said first and second troughs and directing of said at least one eraser assembly into the central trough, and wherein each eraser plate includes an eraser handle fixedly mounted to top surface thereof, wherein each eraser handle includes an erase handle side wall defined by a continuous serpentine configuration to enhance manual grasping thereof.

* * * * *